US005655902A

United States Patent [19]

Doucet

[11] Patent Number: 5,655,902

[45] Date of Patent: Aug. 12, 1997

[54] LIGHTER WITH SPARK-WHEEL SLIP RING

[75] Inventor: Michel Doucet, Bains/s/Oust Redon, France

[73] Assignee: Bic Corporation, Milford, Conn.

[21] Appl. No.: 609,576

[22] Filed: Mar. 1, 1996

[51] Int. Cl.[6] ..... F23D 11/36

[52] U.S. Cl. ..... 431/153; 431/277

[58] Field of Search ..... 431/141, 133, 431/136, 137, 138, 276, 277

[56] References Cited

U.S. PATENT DOCUMENTS

| | | | |
|---|---|---|---|
| 1,872,244 | 8/1932 | Clark et al. | 431/138 |
| 4,717,335 | 1/1988 | Loveless | 431/277 |
| 4,822,276 | 4/1989 | Bisbee | 431/153 |
| 5,096,414 | 3/1992 | Zellweger | 431/153 |
| 5,104,313 | 4/1992 | Zellweger | 431/277 |
| 5,460,516 | 10/1995 | Sher | 431/277 |
| 5,468,144 | 11/1995 | Iwahori | 431/275 |

FOREIGN PATENT DOCUMENTS

| | | | |
|---|---|---|---|
| 255523 | 6/1948 | Switzerland | 431/277 |

*Primary Examiner*—Carl D. Price
*Attorney, Agent, or Firm*—Pennie & Edmonds

[57] ABSTRACT

The lighter of the present invention provides a slip ring which is concentrically mounted about the striking wheel assembly of a conventional lighter. To operate the lighter, digital pressure is applied to frictionally couple the slip ring and the striking wheel assembly together to move in concert to create a spark. The slip ring has disposed along its circumference an elongated slot. The ends of the slot engage the flint housing to halt the movement of the ring, serving to limit the range of motion of the slip ring, and, hence, the motion of the striking wheel assembly. Lastly, the slip ring includes protrusions which hold the slip ring in a neutral position until force is applied in a backward direction to disengage the slip ring.

35 Claims, 10 Drawing Sheets

LIGHTER WITH SPARK-WHEEL SLIP RING

FIELD OF THE INVENTION

The invention relates generally to a lighter having a mechanism for increasing the difficulty of operation, and, more particularly, to a lighter which incorporates a slip ring around the spark wheel which helps to resist undesired use of the lighter by young children.

BACKGROUND OF THE INVENTION

Recently, attention has been directed toward preventing ready actuation of lighters by persons normally unable to appreciate the potential danger of flame. Such danger includes the potential to burn the user directly, to burn the areas surrounding the user, or to burn items in proximity to the user. Persons normally contemplated in these efforts are young children in the age category of under about five years of age.

A conventional roll and press lighter includes a body containing a fuel reservoir filled with a liquified and pressurized hydrocarbon fuel, a valve actuator lever, a striker wheel, a flint in frictional contact with the striker wheel, and a fuel flow control valve in fluid communication with the fuel reservoir. After the striker wheel is rotated against the flint by digital manipulation to produce sparks, the valve actuator lever is depressed allowing gaseous hydrocarbon fuel to flow out of the reservoir through the flow control valve. The sparks emitted by manipulation of the spark wheel ignite the released fuel which produces a flame. Such conventional lighters are known in the art and are commercially available.

It is desirable to increase the difficulty involved in using the conventional lighter in order to limit the ability of young children under about five years of age to operate such lighters. For this reason, there are many proposed "child-resistant" lighters offered in the patent literature and on the commercial market. Examples of such patents include U.S. Pat. No. 5,125,829; U.S. Pat. No. 5,002,482; U.S. Pat. No. 5,165,886; U.S. Pat. No. 5,090,893; and U.S. Pat. No. 5,334,011. Each of these disclosed devices describes a child-resistant feature which somehow acts to block movement of the gas fuel release mechanism to prevent operation of the lighter.

Other proposed "child-resistant" lighters are directed toward dexterity measures which make it more difficult for young children to create a spark by making operation of the lighter more difficult. An example of this type of lighter may be found in U.S. Pat. No. 4,717,335 to Loveless.

Although many of the currently available designs provide a degree of "child-resistance", there is a continuing search in the art for designs which are more user-friendly for the intended adult to operate, while retaining their "child-resistant" qualities.

SUMMARY OF THE INVENTION

Accordingly, it is an object of the present invention to provide a lighter which is operable by an adult, but resistant to operation by young children.

It is a further object of the invention to provide a lighter that can be manufactured with minimal design modifications from the conventional lighter.

It is another object of the invention to provide a child-resistant feature for such a lighter that is retained so as to resist removal by the normal user.

These and other objects are achieved according to the present invention by a lighter which requires that at least a threshold amount of digital pressure, i.e., pressure exerted by a finger or thumb, be applied to a slip ring which surrounds the striking wheel assembly before the striking wheel assembly can be rotated against the flint to create a spark. Further, the present invention may include a means for inhibiting further rotation of the striking wheel after the wheel has been initially struck. The present invention also includes means for holding the striking wheel in a neutral position to inhibit reactivation of the lighter once the lighter has been initially struck.

These features are provided by a lighter which includes a body defining a fuel reservoir and a valve for releasing fuel from the reservoir. A spark producing element is mounted on the body and is rotatable by the user to produce a spark toward the valve. The spark producing element preferably comprises a rotary sparker and at least one turning wheel mounted coaxially with the rotary sparker. The lighter body further includes a cylindrical carriage which houses a flint and is disposed beneath the rotary sparker of the spark producing element. When the spark producing element is rotated, it contacts the flint to produce a spark. A valve actuator is depressible to actuate the valve to release fuel from the body of the lighter. The lighter body also includes spark wheel supports which extend longitudinally from the body above the fuel reservoir. The spark producing element is mounted on the spark wheel supports. The spark wheel supports are preferably formed integrally with the body of the lighter.

The lighter of the present invention further comprises a slip ring which is mounted concentrically about the spark producing element. The slip ring is preferably a cylindrical sleeve which extends 360° around the spark producing element to form a closed loop. The slip ring rotates freely about the striking wheel assembly in both a forward and a backward direction. When digital pressure is applied to the slip ring, the slip ring frictionally engages the spark producing element to rotate the assembly to produce a spark. The slip ring preferably frictionally engages the turning wheels of the spark producing element. The slip ring and the spark producing element work in concert to create a spark toward the valve. The forward rotation of the slip ring is in the direction of rotation for creating a spark directed toward the valve. The backward rotation of the slip ring is in a direction opposite to the forward rotation. The slip ring may be rotated around the spark producing element without frictionally engaging the spark producing element. Therefore, a certain amount of dexterity and physical strength is needed to operate the slip ring to engage the spark producing element and create a spark.

The slip ring further includes an elongated channel which is formed around part of the circumference of the cylindrical sleeve of the slip ring. The elongated channel preferably runs around more than half of the circumference of the sleeve. The channel serves as the means for allowing the rotary sparker to engage the flint. In addition, the channel serves as a means for stopping the motion of the slip ring. During rotation of the slip ring in either the forward or backward direction, whether sufficient digital pressure is applied to engage the spark producing element or not, the ends of the elongated channel engage the cylindrical carriage which extends upward from the body. This engagement stops the motion of the slip ring. A first end of the elongated channel engages a front side of the cylindrical carriage at a neutral position after the slip ring has been rotated in the forward direction. When the first end of the elongated channel engages the cylindrical carriage, further forward motion of the slip ring is halted. The slip ring may then be rotated in the backward direction until a second end of the elongated channel engages a rear side of the cylindrical carriage, thereby halting the backward movement of the slip ring. When the slip ring is in this position, the ready position, it can be rotated in concert with the spark producing element to produce a spark toward the valve.

The invention further includes a means for holding the slip ring in the neutral position. The slip ring preferably includes protrusions which extend laterally from either side of the slip ring. The protrusions are preferably located along the length of the elongated channel near the first end of the channel. During rotation of the slip ring and spark producing element in the forward direction, the protrusions engage the inner walls of the spark wheel supports. Movement of the slip ring in the backward direction is thereby inhibited. The spark wheel supports are preferably composed of a material which is more ductile than the material of the slip ring protrusions. Therefore, when force is exerted on the slip ring during rotation to create a spark, the protrusions are forced past the edge of the inner wall of the supports, causing the inner walls to deform slightly and hold the protrusions firmly in place. Pressure must be exerted in the backward direction to disengage the protrusions from the inner wall of the supports.

In another embodiment, the spark wheel supports preferably have disposed on an inner wall a cavity for engaging the slip ring protrusions. In this embodiment, when the slip ring is rotated in the forward direction, the protrusions engage the cavities and are held in a fixed position until a predetermined force in the backward direction is applied to disengage the protrusions from the cavities. In this embodiment, the protrusions are forced past the inner wall of the support until they reach the cavity.

The exterior surface of the slip ring is preferably serrated to provide a rough edge for engagement by the user's finger. The interior surface of the slip ring, which engages the spark producing element, is preferably smooth. The slip ring is preferably the same width as the spark producing element. The elongated channel is preferably the same width as the rotary sparker.

Thus, a lighter having the above described slip ring with protrusions should provide a young child with sufficient deterrent features to prevent the child from readily producing a flame, or to deter the child from readily producing a flame at least for a time sufficient to permit the normally expected adult intervention.

DETAILED DESCRIPTION OF THE PREFERRED EMBODIMENTS

Figure 1:
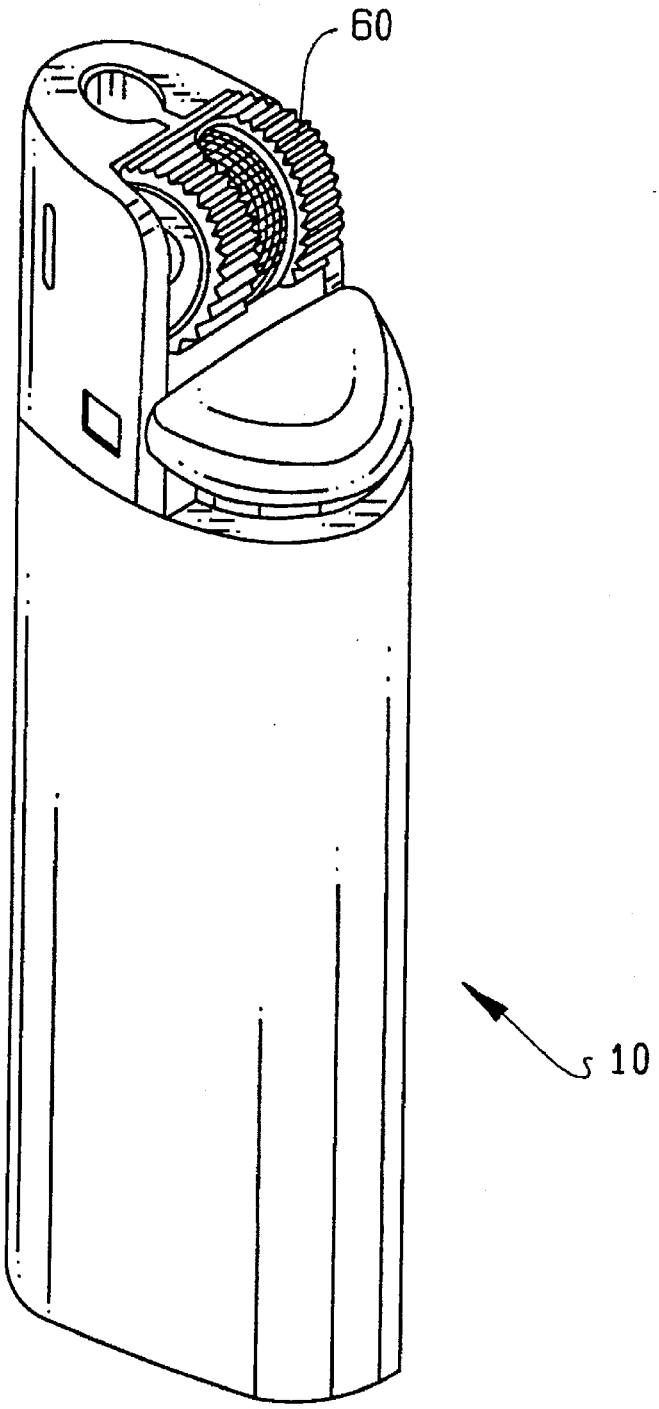
FIG. 1 is a perspective view of a lighter of the present invention with the slip ring in the ready position.
Figure 2:
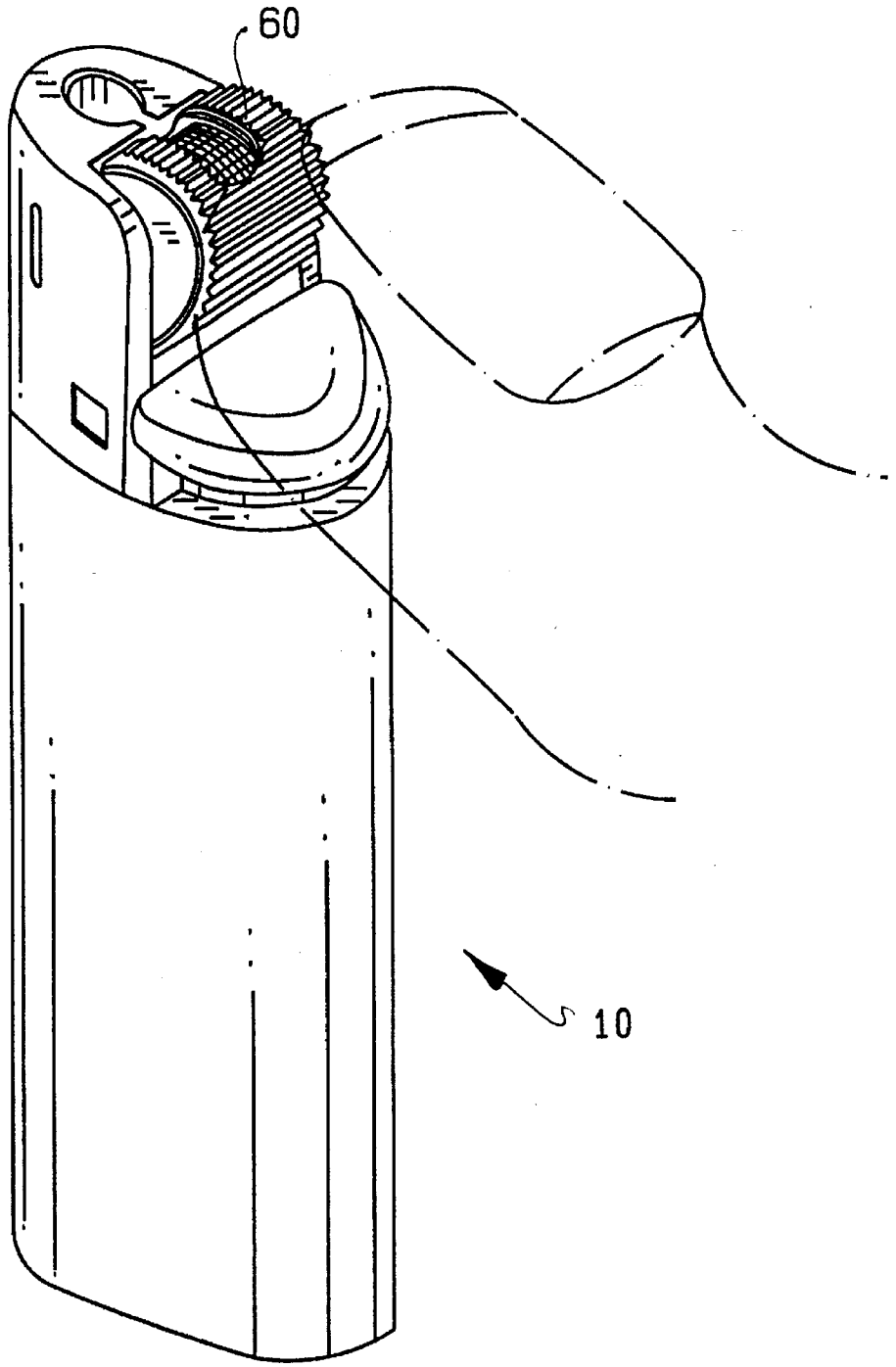
FIG. 2 is a perspective view of a lighter of the present invention with the slip ring in the neutral position.

Referring to the drawings, wherein like reference numbers are used to designate like parts, FIGS. 1 and 2 show lighter 10 according to the present invention as including a slip ring 60 disposed concentrically about the striking wheel. The slip ring 60 in FIG. 1 is shown in the ready position. The ready position is the position at which the lighter may be activated to produce a spark. FIG. 2 shows the lighter 10 of the present invention with the slip ring 60 in the neutral position. When the slip ring 60 is in the neutral position, it cannot be further rotated to create a flame.

Figure 3:
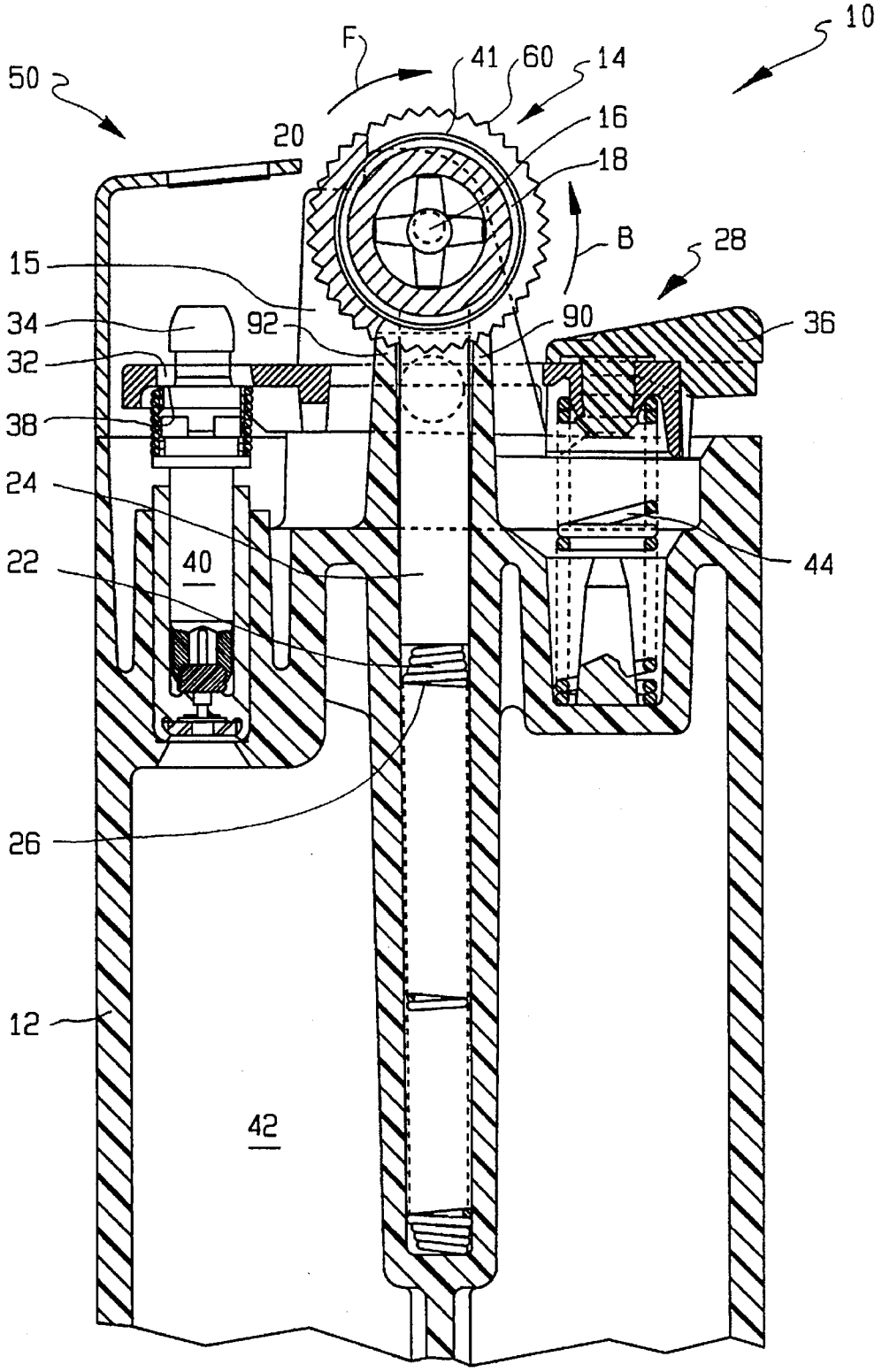
FIG. 3 is a cross-sectional side view of a lighter of the present invention with the slip ring in the ready position.
Figure 4:
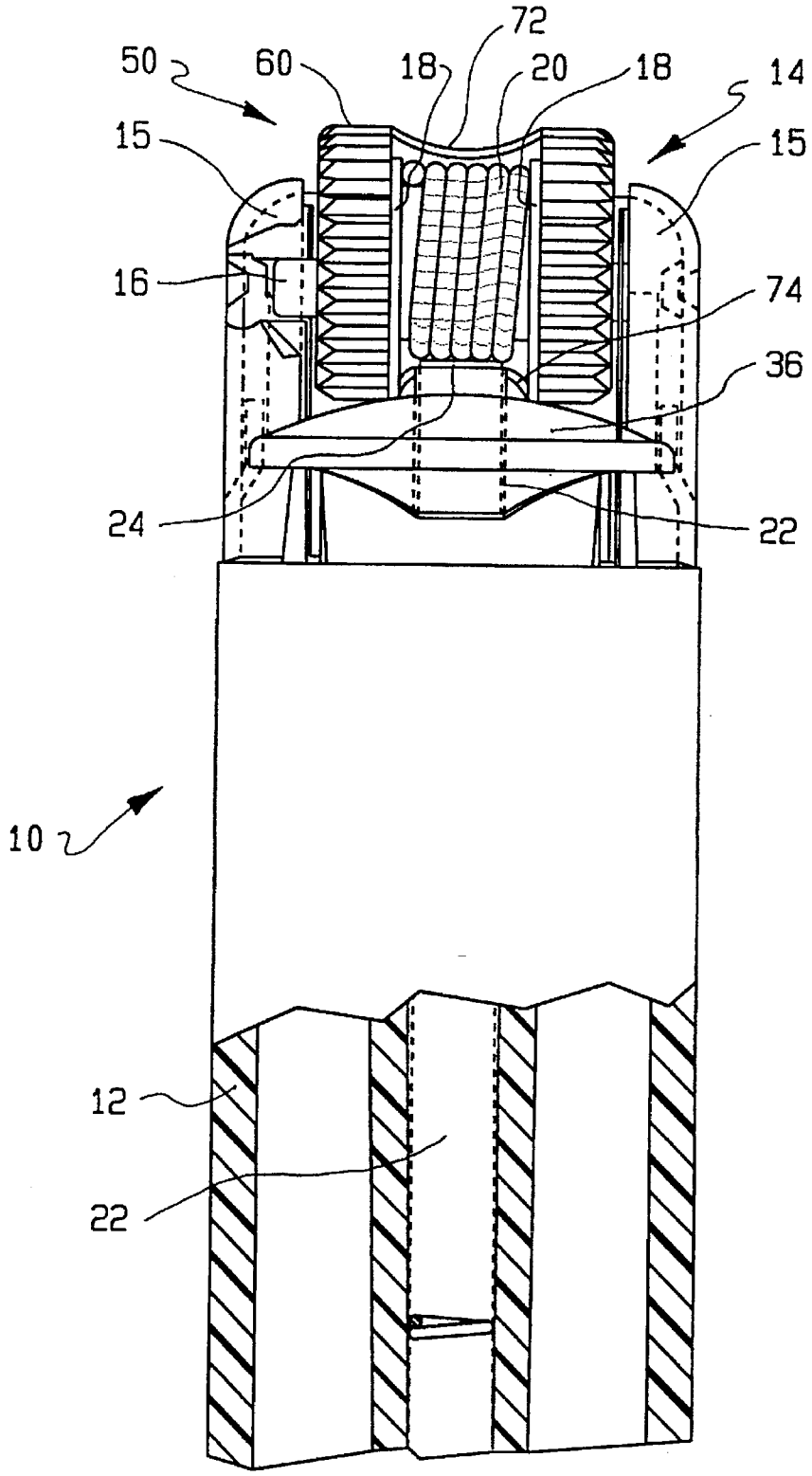
FIG. 4 is a partial cross-sectional rear view of the lighter of the present invention with the slip ring in the ready position.

More particularly, as shown in FIGS. 3 and 4, lighter 10 has body 12 with striking wheel assembly 14 disposed between spark wheel supports 15 (shown partially in phantom in FIG. 4) via axle 16. Striking wheel assembly 14 is located at the top end of body 12 and comprises turning wheels 18 disposed on each side of rotary sparker 20. The two turning wheels 18 and sparker 20 are connected to one another and are mounted coaxially on axle 16. Body 12 defines a cylindrical carriage 22 forming a cavity positioned longitudinally and centrally within body 12. Flint 24 is disposed within carriage 22, and is urged into frictional contact with the rotary sparker by spring 26.

Figure 6:
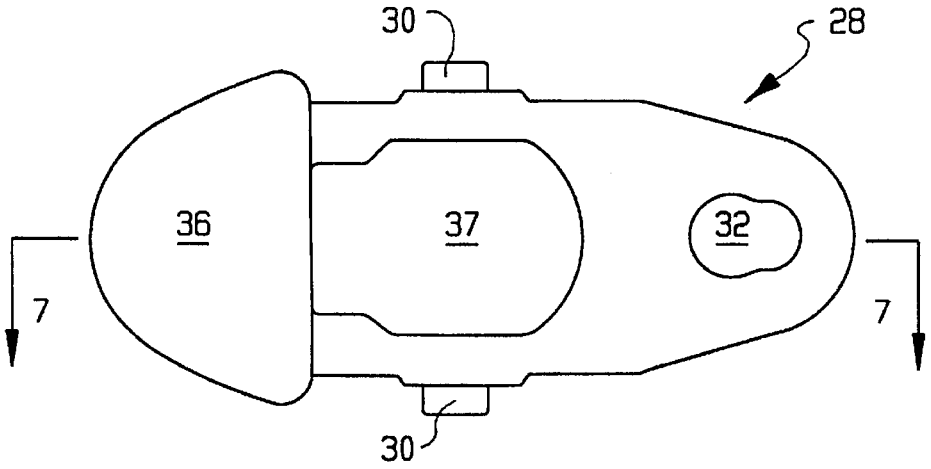
FIG. 6 is a top plan view of a valve actuator of the present invention.
Figure 7:
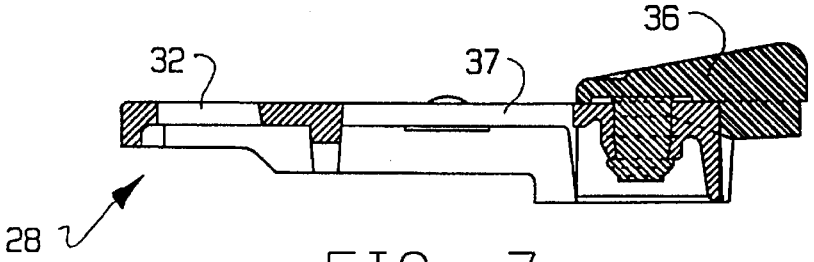
FIG. 7 is a cross-sectional view of a valve actuator of the present invention along line 7—7 in FIG. 6.

Lighter 10 further comprises a valve actuator 28, which is pivotally mounted on body 12 through tabs 30, which are located below axle 16. As shown in FIGS. 6 and 7, valve actuator 28 defines slot 32 at one end for receiving the valve. At the other end of the valve actuator 28 is thumb pad 36. In its middle region, valve actuator 28 defines an opening 37, which allows flint 24 to extend from lighter body 12 through valve actuator 28 to reach rotary sparker 20.

Figure 5:
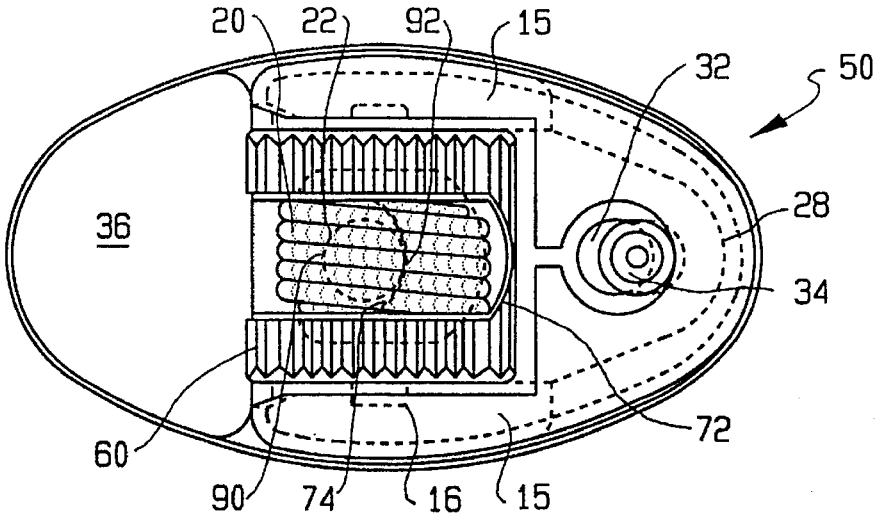
FIG. 5 is a top view of the lighter of the present invention with the slip ring in the ready position.

Referring to FIGS. 3 and 5, valve 34 controls the release of fuel from reservoir 42. In this embodiment of the present invention, valve 34 is a normally open valve, forced open by the pressure of fuel within reservoir 42. In this embodiment, as shown in FIG. 3, valve actuator 28 acts on valve 34 to maintain it in a closed position. Compression spring 44 pushes up on a first end of valve actuator 28, forcing the second, opposite end to act downwardly on valve 34 where it extends through slot 32. This pressure maintains the valve in a closed position until thumb pad 36 is sufficiently depressed allowing the stem of valve 34 to move upward and thereby releasing the fuel. Second compression spring 38 acts between the valve actuator and valve stem to prevent the release of fuel before the thumb pad 36 is depressed to a sufficiently actuated position. It is contemplated that other suitable valve configurations may be selected by persons of ordinary skill in the art. For example, a normally closed valve, which is forced open by the lifting of the second end of the valve actuator due to depression of the thumb pad may be utilized.

Lighter 10 also has shield 50 mounted on top of body 12 enclosing the spark wheel supports 15 and around valve 34, as shown in FIG. 5. Shield 50 assists in the generation and maintenance of the flame.

Figure 8A:
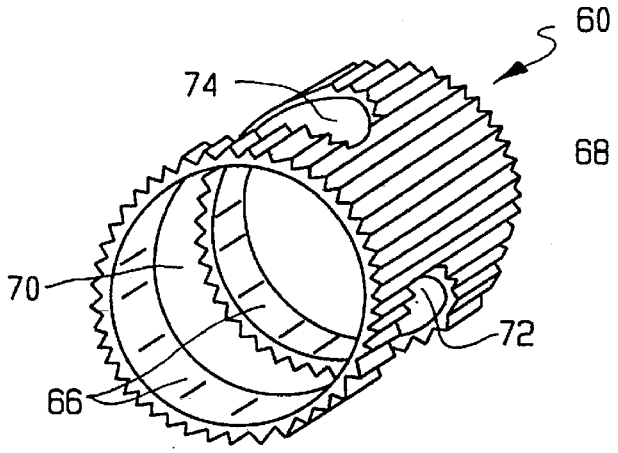
FIG. 8A is a perspective view of an embodiment of the slip ring of the present invention.

The lighter 10 of the current invention further includes a slip ring 60 as shown in FIG. 8A. Slip ring 60 is mounted concentrically about the striking wheel assembly 14 as is shown in FIGS. 1–5.

Referring to FIG. 8A, the slip ring 60 comprises a cylindrical sleeve which preferably extends 360° around the striking wheel assembly 14 to form a closed loop. The cylindrical sleeve has an elongated channel 70 formed around part of the circumference of the sleeve. Preferably, the elongated channel 70 runs around more than about half of the circumference of the sleeve. The exterior surface 68 of the slip ring 60 is preferably serrated in order to make it easier to grip by the user. The inner surface 66 of the slip ring 60 is preferably smooth.

Figure 8B:
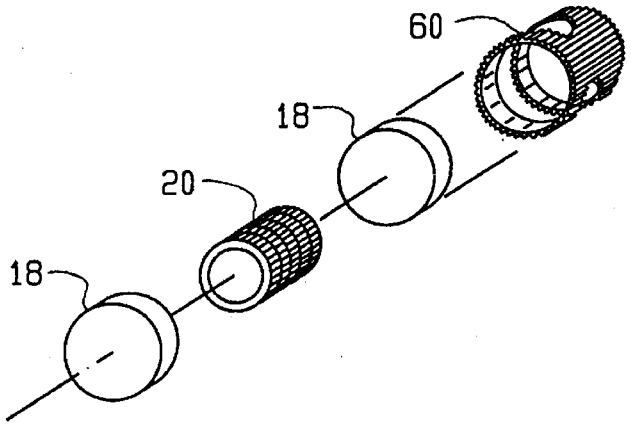
FIG. 8B is an exploded perspective view of a spark wheel assembly according to one embodiment of the invention.

FIG. 8B shows the slip ring 60 in conjunction with the turning wheels 18 and the rotary sparker 20. The two turning wheels 18 are placed on the ends of the rotary sparker 20 to form the striking wheel assembly 14. The slip ring 60 is placed around the striking wheel assembly 14.

Referring now to FIG. 3, the slip ring 60 is disposed concentrically about the striking wheel assembly 14. A space 41 is shown between the slip ring 60 and the striking wheel assembly 14. The space 41 shown in FIG. 3 is greatly exaggerated to demonstrate that a space exists, but the actual space should be suitable to allow the slip ring 60 to slip around the striking wheel assembly 14 to frictionally engage the turning wheels 18 when digital pressure is applied.

Since the slip ring 60 entirely surrounds the striking wheel assembly 14, it may only be removed by the user by disassembling the lighter 10. The slip ring may rotate freely about the striking wheel assembly 14 in either a forward F or backward B direction of rotation. In order to operate the lighter 10 to produce a spark, digital pressure is applied to the slip ring 60 during rotation of the slip ring 60 in a forward F direction. When pressure is applied toward the axis of the striking wheel assembly 21, the slip ring 60 frictionally engages the turning wheels 18 and rotates the same to create a spark toward the valve. After the user digitally rotates the slip ring 60 in concert with the striking wheel assembly 14 to create a spark, the user's digit then moves to depress the thumb pad 36 to open the fuel valve 34 in order to produce a flame.

The slip ring interior surface 66 is preferably smooth and preferably engages only the turning wheels 18 of the striking wheel assembly 14 during rotation. Examples of materials which may be used for the slip ring 60 include brass, zinc, or plastic. Other embodiments utilizing other materials may also be used and the slip ring 60 of the present invention should not be limited to the above examples.

It is not necessary that the slip ring 60 engage the rotary sparker 20. Slip ring 60 is preferably the same width as the striking wheel assembly 14. The elongated channel 70 is preferably about the same width as the rotary sparker 20. The elongated channel must be wide enough to accommodate the width of the flint 24 which is disposed in the cylindrical carriage 22. Preferably, elongated channel 70 is wide enough to accommodate both the cylindrical carriage 22 and the flint 24.

Referring to FIGS. 3–5, means for preventing further forward rotation F of the striking wheel assembly 14 after an initial forward rotation F is provided by the first end 72 of the elongated channel 70. Similarly, means for preventing backward rotation of the striking wheel assembly 14 is provided by a second end 74 of the elongated channel 70. In operation, the slip ring 60 is preferably initially positioned in the ready position as shown in FIG. 1. When pressure is applied to the slip ring 60 to engage the turning wheels 18, the striking wheel assembly 14 rotates in the forward direction F to create a spark toward the valve 34. Rotation of the slip ring 60 in the forward direction F is halted when the first end 72 of the elongated channel 70 engages a front surface 90 of the cylindrical carriage 22, which is disposed beneath the rotary sparker 20. When the slip ring 60 is in this position, it is neutralized. It cannot be rotated further in the forward direction F to create a spark. The neutral position of the slip ring 60 is depicted in FIG. 2. In order to reactivate the striking wheel assembly 14, the slip ring 60 must be rotated in the backward direction B. As the slip ring 60 is rotated in the backward direction B, the second end 74 of elongated channel 70 engages a rear surface 92 of the cylindrical carriage 22, thereby halting the rotation of the slip ring 60 in the backward direction B. This rotation series brings the slip ring 60 back to the ready position shown in FIG. 1.

Figure 9:
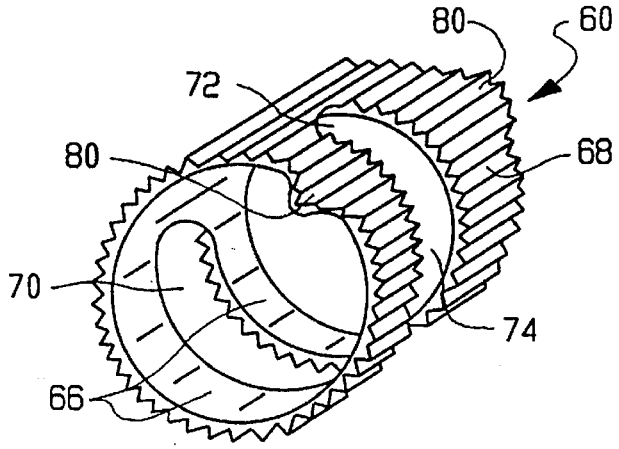
FIG. 9 is a perspective view of another embodiment of the slip ring of the present invention.

Means for holding the striking wheel assembly 14 in the neutral position to inhibit reactivation of the lighter 10 once the lighter 10 has been struck is provided in another embodiment of the present invention as is shown in FIG. 9. In this embodiment, the slip ring 60 further comprises at least one protrusion 80 and preferably a pair of protrusions 80. Protrusions 80 extend laterally from the sides of the slip ring and serve to widen the slip ring 60 at their location of placement. Protrusions 80 are preferably located along the length of the elongated channel 70 and, most preferably, are located near the first end 72 of the elongated channel 70. Protrusions 80 are preferably integrally formed with the slip ring 60.

Figure 10:
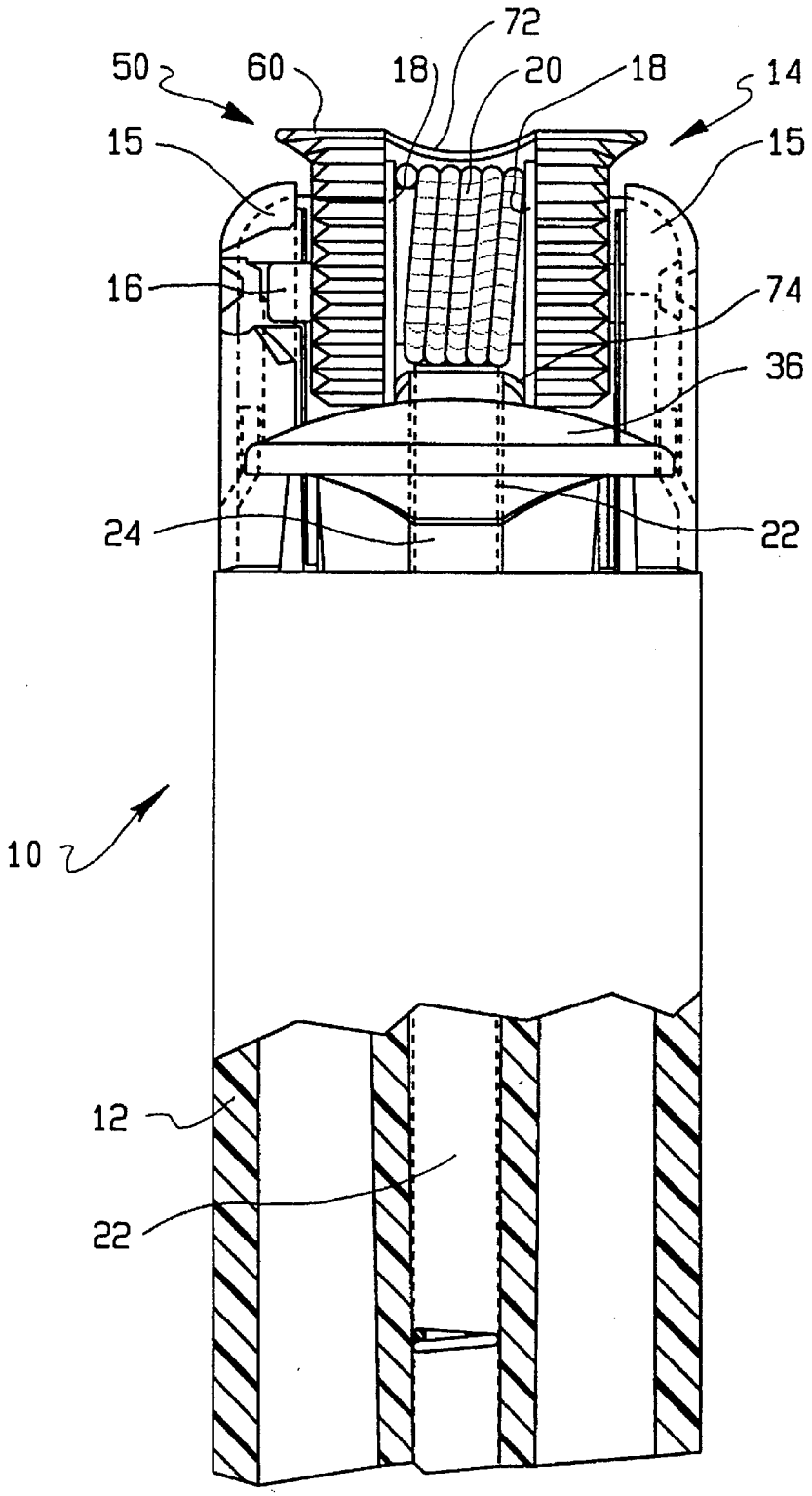
FIG. 10 is a partial cross-sectional rear view of the lighter of another embodiment of the present invention with the slip ring in the ready position.
Figure 13:
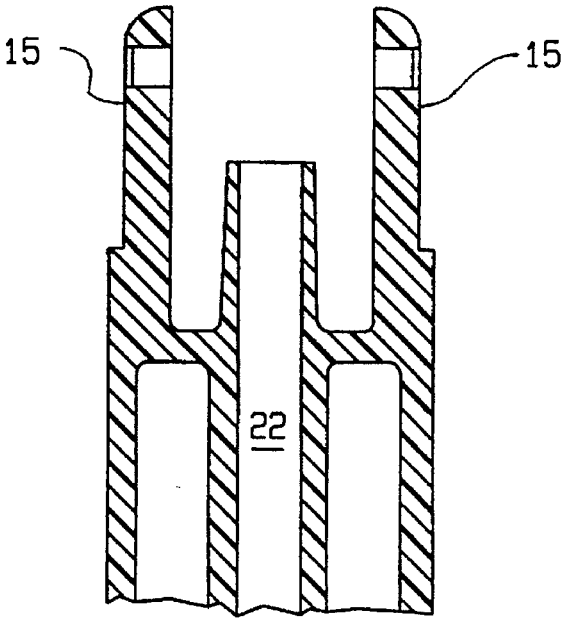
FIG. 13 is a partial cross-sectional view of the body of the lighter of present invention.

As discussed above, the body of the lighter includes a pair of spark wheel supports 15 which extend from the top of body 12 of lighter 10 to hold striking wheel assembly 14 in place. Spark wheel supports 15 are shown in FIG. 13 and in phantom in FIGS. 10 and 11. Spark wheel supports 15 are preferably formed integrally with body 12 as is shown in FIG. 13.

Figure 11:
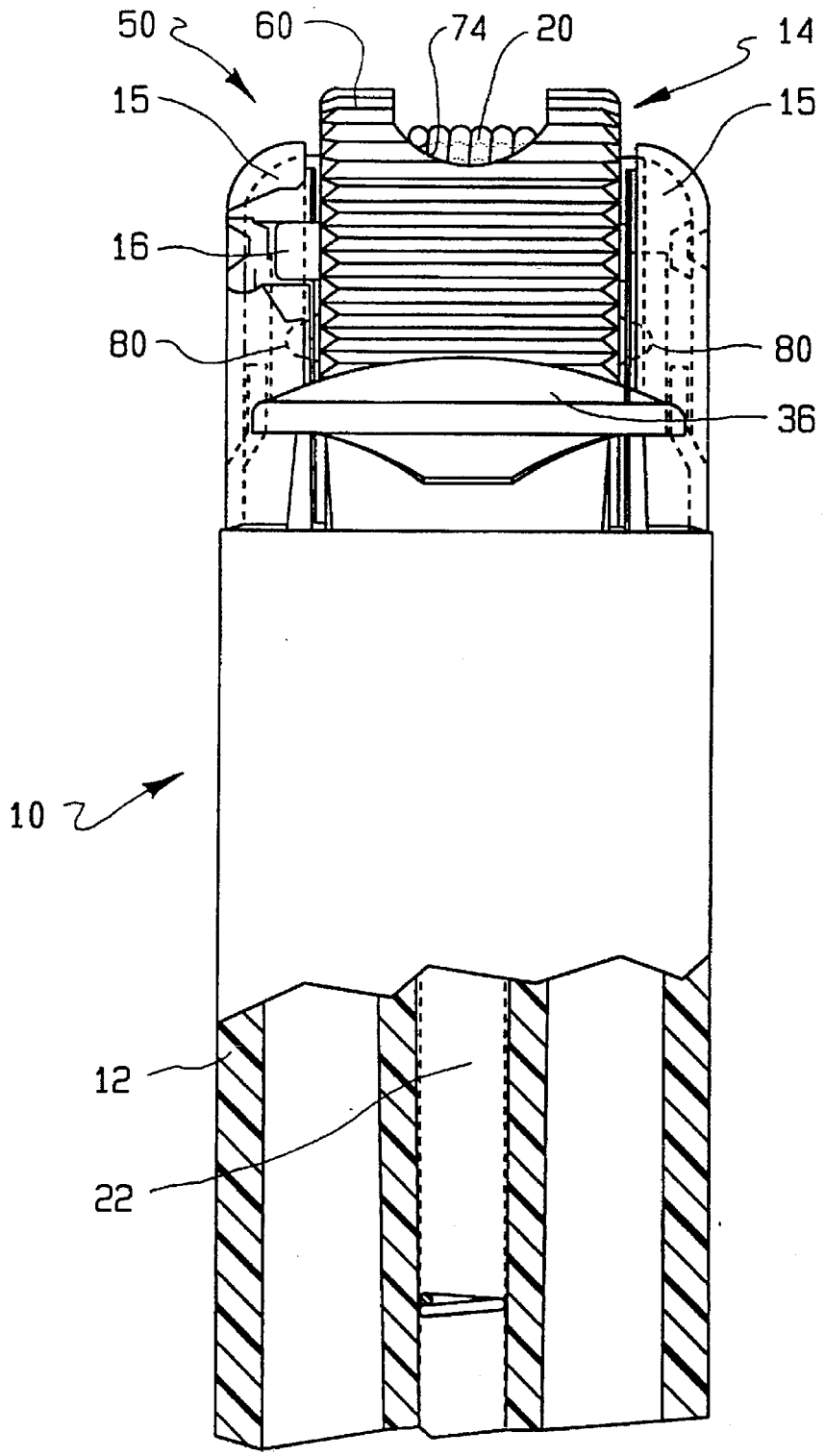
FIG. 11 is a partial cross-sectional rear view of the lighter of another embodiment of the present invention with the slip ring in the neutral position.
Figure 12:
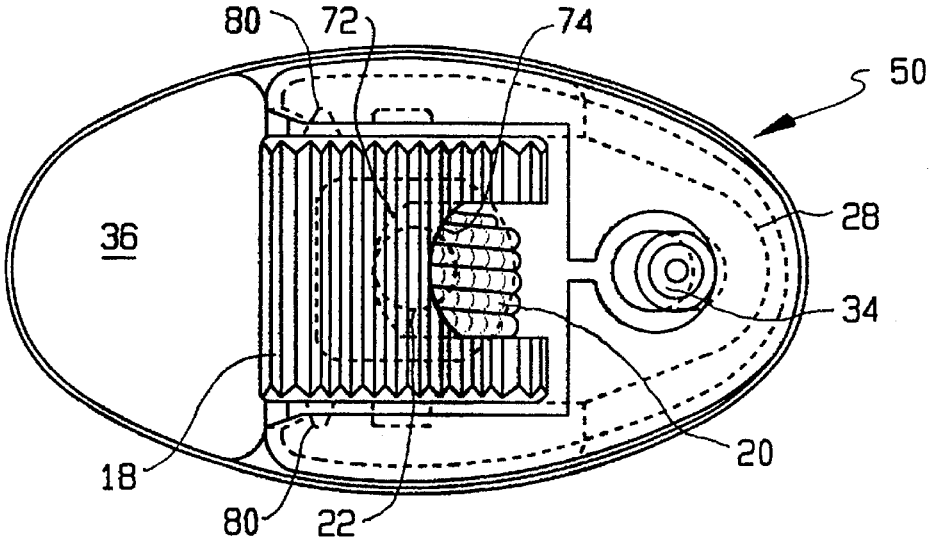
FIG. 12 is a top view of another embodiment of the lighter of the present invention with the slip ring in the neutral position.

Referring to FIGS. 11 and 12, in operation, as slip ring 60 is rotated from the ready position to the neutral position to create a spark toward valve 34, slip ring protrusions 80 engage the inner walls of spark wheel supports 15 as slip ring 60 reaches the neutral position. Protrusions 80 are forced past the front edge of spark wheel supports 15 until they are firmly engaged by the inner walls of the spark wheel supports 15. In order to disengage the protrusions 80, a greater predetermined force must be applied to the slip ring 60 in a backward direction of rotation B.

Spark wheel supports 15 are preferably composed of a material which is more resiliently deformable than the material of the slip ring protrusions 80 so that the material of the spark wheel supports 15 will be resiliently deformed, e.g., spread apart, to receive the protrusions 80 when force is applied during movement of the slip ring 60 from the ready position to the neutral position.

Figure 14:
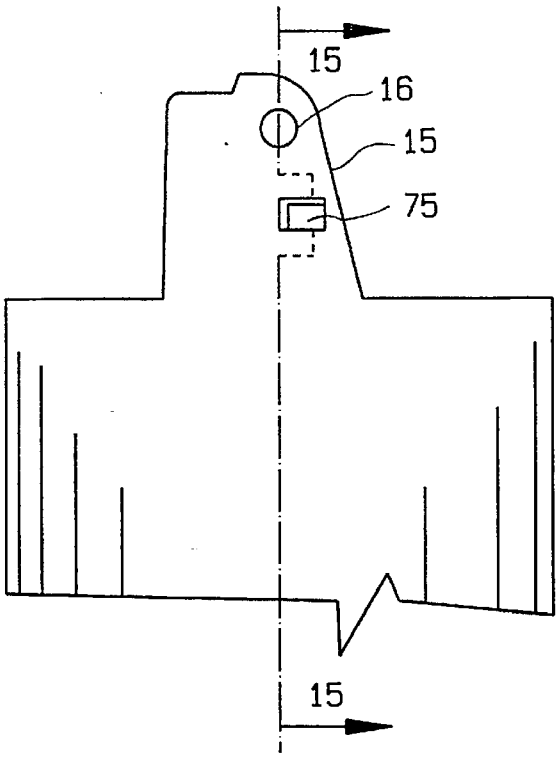
FIG. 14 is a partial interior side view of the spark wheel supports of another embodiment of the present invention.
Figure 15:
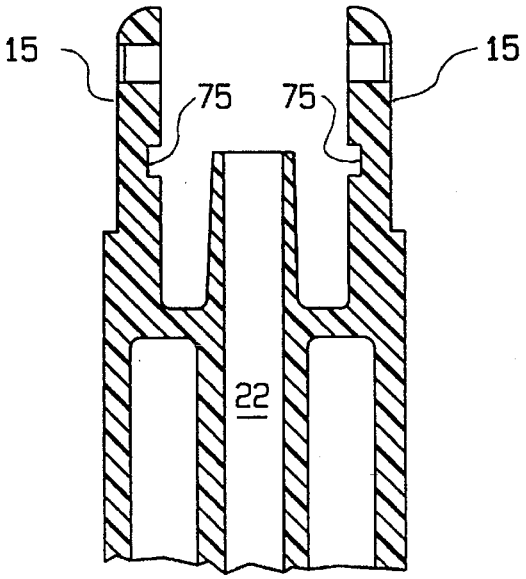
FIG. 15 is a cross-sectional view of another embodiment of the body of the lighter of the present invention.

In another embodiment of the present invention as shown in FIGS. 14 and 15, the spark wheel supports 15 may include an inner wall cavity 75 for receiving the slip ring protrusions 80. In this embodiment, slip ring protrusions 80 must pass by an edge of spark wheel supports 15 until they engage the cavity 75. A predetermined force must be used to disengage the protrusions from the cavities 75 in the backward direction B.

The lighter as described above is more difficult to operate and potentially "child-resistant" because generally children under five years of age do not have the needed dexterity to apply digital pressure to rotate the slip ring 60 in concert with the striking wheel assembly 14. In addition, a child under the age of five may not have the intelligence to determine that the slip ring 60 must be repositioned at the ready position after an attempt to strike the lighter 10 has been made.

While various descriptions of the present invention are described above, it is understood that the various features of the present invention can be used singly or in any combination thereof. Namely, a conventional spark wheel assembly can be modified to include the protrusions of the present invention. Therefore, this invention is not to be limited to only the specifically preferred embodiments depicted herein.

We claim:

1. A lighter comprising:

a lighter body containing a fuel reservoir with a valve for releasing fuel therefrom;

a spark producing element rotatable by a user to produce a spark directed toward said valve, said element is mounted on the lighter body;

a valve actuator depressible to actuate said valve and release said fuel; and an annular member slideably mounted around said spark producing element and defining a circular inner surface, said inner surface being frictionally engageable with a circular outer surface of said spark producing element in response to pressure applied to said annular member, wherein application of sufficient digital pressure by a user to said annular member permits the user to rotate the spark producing element to produce a spark for igniting fuel.

2. The lighter as set forth in claim 1, wherein the annular member comprises a cylindrical sleeve which extends 360° around the spark producing element to form a closed loop.

3. The lighter as set forth in claim 2, wherein the annular member has an elongated channel formed around part of the circumference of the sleeve.

4. The lighter as set forth in claim 3, wherein the elongated channel runs around more than half of the circumference of the sleeve.

5. A lighter comprising:

a lighter body containing a fuel reservoir with a valve for releasing fuel therefrom;

a spark producing element having an outer surface mounted on the lighter body and rotatable by a user to produce sparks directed toward the valve;

an annular member slideably mounted around said spark producing element and defining an inner surface being frictionally engageable with said outer surface of said spark producing element in response to pressure applied to said annular member wherein application of sufficient digital pressure by a user to said annular member permits the user to rotate the spark producing element to produce a spark for igniting the fuel; and means for limiting rotation of the annular member to less than 360° in one direction.

6. The lighter according to claim 5, wherein said means for limiting rotation comprises:

an upstanding member extending from the lighter body toward the spark producing element; and a slot having ends defined by the annular member, extending partly around the annular member, wherein said upstanding member is received in said slot to permit rotation of the annular member with said rotation limited by interference between said slot ends and the upstanding member.

7. A lighter comprising:

a body having a fuel reservoir and defining a central cylindrical carriage;

a striking wheel assembly rotatably mounted on the body at a top end, wherein the striking wheel assembly comprises a rotary sparker and at least one turning wheel mounted coaxially with the rotary sparker;

a flint disposed within the cylindrical carriage and in frictional contact with the rotary sparker, wherein rotation of the rotary sparker against the flint creates a spark;

a valve for releasing fuel from the fuel reservoir to outside the body of the lighter, wherein the valve has an open position and a closed position;

a valve actuator pivotally attached to the body, wherein the actuator controls movement of the valve between the open position and closed position; and an annular member forming a cylindrical sleeve having an elongated slot formed around part of the circumference of the sleeve, said cylindrical sleeve mounted around said striking wheel assembly and contacting the turning wheels of said striking wheel assembly, wherein manipulation of said striking wheel assembly is prevented until a force sufficient to frictionally couple said annular member to said turning wheels is applied.

8. The lighter as set forth in claim 7, wherein the elongated slot of the annular member receives the cylindrical carriage and flint, thereby permitting the rotary sparker to engage the flint to create a spark during rotation of the annular member in concert with the striking wheel assembly.

9. The lighter as set forth in claim 8, wherein the elongated slot comprises:

a first end which engages a front side of the carriage at a neutral position after rotation of the annular member toward the user to prevent further motion of the annular member toward the user; and a second end which engages a rear side of the carriage at a ready position after the annular member is rotated away from the user.

10. The lighter as set forth in claim 9, wherein the annular member further includes a pair of protrusions which extend laterally from each side of the annular member at the same cross-section of the annular member, said protrusions making said annular member wider at the selected cross-sectional position.

11. The lighter as set forth in claim 10, wherein the selected cross-sectional position of placement of the protrusions is along the elongated slot in proximity to the first end of said slot.

12. The lighter as set forth in claim 10, wherein the body further comprises a pair of spark wheel supports which extend longitudinally from the body above the fuel reservoir, said striking wheel assembly and annular member being mounted on said spark wheel supports.

13. The lighter as set forth in claim 12, wherein the annular member protrusions engage an inner wall of the spark wheel supports after the striking wheel assembly has been rotated to create a spark, said annular member protrusions being held in a fixed position against the inner walls of the spark wheel supports, wherein a predetermined force is applied to disengage the protrusions from the inner walls of the spark wheel supports in the direction of rotation away from the user to position the annular member in the ready position.

14. A lighter comprising:

a lighter body containing a fuel reservoir with a valve for releasing fuel therefrom;

a spark producing element rotatable by a user to produce a spark directed toward said valve, said element is mounted on the lighter body and has a rotary sparker and at least one turning wheel;

a valve actuator depressible to actuate said valve and release said fuel; and an annular member slideably mounted around said rotary sparker and said at least one turning wheel of said spark producing element and defining an inner surface, said inner surface being frictionally engageable with an outer surface of said at least one turning wheel in response to pressure applied to said annular member, wherein application of sufficient digital pressure by a user to said annular member permits the user to rotate the spark producing element to produce a spark for igniting fuel.

15. The lighter as set forth in claim 14 further comprises a means for limiting rotation of the annular member to less than 360° in one direction.

16. The lighter as set forth in claim 14, wherein the annular member comprises a cylindrical sleeve which extends 360° around the spark producing element to form a closed loop.

17. The lighter as set forth in claim 16, wherein the annular member has an elongated channel formed around part of the circumference of the sleeve.

18. The lighter as set forth in claim 17, wherein the elongated channel runs around more than half of the circumference of the sleeve.

19. The lighter as set forth in claim 17, wherein said at least one turning wheel is mounted coaxially with the rotary sparker, said annular member being of approximately the same width as the spark producing element, said elongated channel being approximately the same width as the rotary sparker.

20. The lighter as set forth in claim 19, wherein:

the lighter body includes an upstanding member disposed beneath the rotary sparker, said upstanding member having disposed therein a flint; and the elongated channel defines an opening through which said flint contacts said spark producing element.

21. The lighter as set forth in claim 20, wherein:

a first end of the elongated channel engages a front side of the upstanding member at a neutral position after forward rotation of the annular member, thereby preventing further rotation of the annular member in concert with the spark producing element, said forward direction being the direction of rotation for creating a spark toward the valve; and a second end of the elongated channel engages a rear side of the upstanding member at a ready position after the annular member is rotated in a backward direction about the spark producing element in order to prepare the annular member for rotation to create a spark, said backward direction being opposite to said forward direction, wherein when the annular member is rotated from the neutral position to the ready position, the annular member may rotate about the spark producing element without frictionally engaging the spark producing element.

22. A lighter comprising:

a lighter body containing a fuel reservoir with a valve for releasing fuel therefrom;

a spark producing element rotatable by a user to produce a spark directed toward said valve, said element mounted on the lighter body;

a valve actuator depressible to actuate said valve and release said fuel; and an annular member slideably mounted around said spark producing element and being frictionally engageable with said element in response to pressure applied to said annular member, wherein application of sufficient digital pressure by a user to said annular member permits the user to rotate the spark producing element to produce a spark for igniting fuel;

wherein the annular member comprises a cylindrical sleeve which extends 360° around the spark producing element to form a closed loop; and wherein the annular member has an elongated channel formed around part of the circumference of the sleeve.

23. The lighter as set forth in claim 22, wherein the elongated channel runs around more than half of the circumference of the sleeve.

24. The lighter as set forth in claim 22, wherein the annular member has an exterior surface which is serrated.

25. The lighter as set forth in claim 22, wherein the annular member has an interior surface which is smooth, said interior surface engaging said spark producing element.

26. The lighter as set forth in claim 22, wherein the spark producing element comprises:

a rotary sparker; and at least one turning wheel mounted coaxially with the rotary sparker, said annular member being of approximately the same width as the spark producing element, said elongated channel being approximately the same width as the rotary sparker.

27. The lighter as set forth in claim 26, wherein the annular member has an interior surface which is smooth, said interior surface engaging the at least one turning wheel.

28. The lighter as set forth in claim 26, wherein:

the lighter body includes an upstanding member disposed beneath the rotary sparker, said upstanding member having disposed therein a flint; and the annular member elongated channel defines an opening through which said flint is received by said spark producing element.

29. The lighter as set forth in claim 28, wherein:

a first end of the elongated channel engages a front side of the upstanding member at a neutral position after forward rotation of the annular member, thereby preventing further rotation of the annular member in concert with the spark producing element, said forward direction being the direction of rotation for creating a spark toward the valve; and a second end of the elongated channel engages a rear side of the upstanding member at a ready position after the annular member is rotated in a backward direction about the spark producing element in order to prepare the annular member for rotation to create a spark, said backward direction being opposite to said forward direction, wherein when the annular member is rotated from the neutral position to the ready position, the annular member may rotate about the spark producing element without frictionally engaging the spark producing element.

30. The lighter as set forth in claim 29, wherein the spark wheel supports are formed integrally with the body of the lighter.

31. The lighter as set forth in claim 29, wherein the spark producing means is mounted on a pair of spark wheel supports, said spark wheel supports being an extension of the lighter body and extending longitudinally from the body above the fuel reservoir.

32. The lighter as set forth in claim 31, wherein the annular member further comprises at least one protrusion extending laterally therefrom, said protrusions engaging the spark wheel supports of the lighter when the annular member is moved to the neutral position to inhibit backward rotation of the annular member.

33. The lighter as set forth in claim 32, wherein the annular member protrusions engage an inner wall of the spark wheel supports, said annular member being held in fixed position when said protrusions engage said spark wheel supports, wherein a predetermined force is needed to disengage the protrusions from the inner wall of the spark wheel supports in a backward direction.

34. The lighter of claim 32, wherein the spark wheel supports are composed of a material which is more resilient than the material of the annular member protrusions so that the material of the spark wheel supports resiliently deforms to allow the supports to receive the annular member protrusions when force is applied during movement of the annular member from the ready position to the neutral position.

35. The lighter of claim 33, wherein the spark wheel supports have disposed on an inner wall a cavity, wherein the annular member protrusions engage said cavities after rotation of the annular member from the ready to the neutral position, said annular member being held in fixed position when said protrusions engage said cavities, a pre-determined force being needed to disengage the protrusions from the cavities in a backward direction.

* * * * *